US008721364B2

(12) United States Patent
Lai et al.

(10) Patent No.: US 8,721,364 B2
(45) Date of Patent: May 13, 2014

(54) CONNECTORS

(71) Applicant: Giga-Byte Technology Co., Ltd., New Taipei (TW)

(72) Inventors: Chih Ming Lai, New Taipei (TW); Chia Chen Wang, New Taipei (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 10 days.

(21) Appl. No.: 13/738,711

(22) Filed: Jan. 10, 2013

(65) Prior Publication Data

US 2013/0178077 A1 Jul. 11, 2013

(30) Foreign Application Priority Data

Jan. 11, 2012 (TW) ..... 101101029 A

(51) Int. Cl.
*H01R 13/66* (2006.01)

(52) U.S. Cl.
CPC ..... *H01R 13/66* (2013.01)
USPC ..... 439/541.5; 439/540.1; 439/638

(58) Field of Classification Search
CPC ..... H01R 13/6658; H01R 13/65807; H01R 12/724; H01R 13/6461; H01R 13/6587; H01R 12/58; H01R 12/7082; H01R 13/658; H01R 13/6581; H01R 13/659; H01R 13/6595; H01R 13/6596; H01R 13/60; H01R 12/70
USPC ..... 439/541.5, 65
See application file for complete search history.

(56) References Cited

U.S. PATENT DOCUMENTS

| | | | | |
|---|---|---|---|---|
| 6,162,089 | A * | 12/2000 | Costello et al. | 439/541.5 |
| 6,174,198 | B1 * | 1/2001 | Wu et al. | 439/541.5 |
| 6,200,161 | B1 * | 3/2001 | McClinton et al. | 439/541.5 |
| 6,250,958 | B1 * | 6/2001 | Hsish | 439/541.5 |
| 6,688,913 | B2 * | 2/2004 | Li | 439/541.5 |
| 6,976,870 | B1 * | 12/2005 | Li | 439/541.5 |
| 7,677,923 | B1 * | 3/2010 | Chen et al. | 439/541.5 |
| 7,762,840 | B2 * | 7/2010 | Hamner et al. | 439/541.5 |
| 8,062,062 | B1 * | 11/2011 | Guo et al. | 439/540.1 |
| 2009/0298338 | A1 * | 12/2009 | Zhang et al. | 439/607.28 |
| 2010/0035466 | A1 * | 2/2010 | Lee et al. | 439/541.5 |
| 2010/0062618 | A1 * | 3/2010 | Lai et al. | 439/63 |
| 2010/0285694 | A1 * | 11/2010 | He | 439/638 |

* cited by examiner

*Primary Examiner* — Briggitte R Hammond
(74) *Attorney, Agent, or Firm* — Chun-Ming Shih

(57) ABSTRACT

An electrical connector, which is adapted to a printed circuit board (PCB) with a first connection port, comprises a bottom having a base and a conductive element mounted in an opening of the base, a second connection port disposing on the base, and a housing covering the bottom. When the bottom is disposed on the PCB, the first connection port is accommodated in the opening of the base, and an elastic strip of the conductive element presses on the first connection port toward a direction parallel to the PCB for combining the electrical connector and the first connection port on the PCB, and preventing the separation or loose connection of the electrical connector from the first connection port or the PCB.

20 Claims, 8 Drawing Sheets

CONNECTORS

CROSS-REFERENCE TO RELATED APPLICATIONS

This application claims the benefit of the filing date of Taiwan Patent Application No. 101101029, filed on Jan. 11, 2012, in the Taiwan Intellectual Property Office, the disclosure of which is incorporated herein in its entirety by reference.

BACKGROUND OF THE INVENTION

1. Field of the Invention

The invention relates to an electrical connector; more particularly, to a stacked electrical connector.

2. Description of the Prior Art

Recently, as the computer moves towards a thin and compact product, the size of motherboard in the computer is reduced, resulting in a limited space on the motherboard for the electrical components. Therefore, similar or different types of connectors or connection ports are assembled on the motherboard in a stacked way in order to optimize the space utilization. For example, multiple universal serial bus (referred to as USB hereinafter) (connection) ports may be arranged collectively on an insulator; alternatively, a number of different types of connection ports, such as USB ports, RJ45 ports, IEEE 1394 ports and high definition multimedia interface (referred to as HDMI hereinafter) ports, may be grouped together on a single insulator to form a stacked connector with multiports.

However, due to the property of high transmission rate of the connection port, high frequency electromagnetic wave (known as "electromagnetic (EM) radiation") is emitted during the signal transmission process, by which the digital signal transmitted through the connector and further the operation of other electrical components in the computer will be affected adversely (known as "electromagnetic interference", EMI). As a common solution, a conductive metal shell is formed to cover the insulator on which the connector is located and to secure to the motherboard at the same time. In this way, effective EM shielding can be provided because of the contact between the metal shell and the motherboard.

A stacked connector has been developed in which an open accommodating space is additionally formed in the insulator where multiple connection ports are located. The open accommodating space is for a single connection port that has been previously disposed on the motherboard. Thus, the single connection port such as a HDMI port, USB port, or display port on the motherboard may be housed in the accommodating space of the stacked connector when connected to the stacked connector and then becomes a unity with the stacked connector.

On the other hand, a conductive elastic strip is located in the accommodating space of the stacked connector to be in contact with the metal shell for the EMI shielding of the connection port on the motherboard. When the stacked connector is connected with the connection port on the motherboard, the conductive elastic strip will be pressed against a top surface of the connection port, which is away from the motherboard, to connect the connection port to the ground or to shield the connection port from the EMI by a contact relationship between the conductive elastic strip, the metal shell, and the motherboard.

However, some problems are involved in the above process. In general, the connection port of the circuit board is covered by the stacked connector such that pins of the stacked connector penetrate through the motherboard. Next, the pins of the stacked connector are welded to the motherboard by for example reflow soldering. Particularly, since the conductive elastic strip in the connection port on the motherboard in contact with the stacked connector is resilient in nature and therefore easy to be separate from or in loose connection with the connection port owing to any vibration or shake during the process, not all of the pins of the stacked connector can penetrate through the motherboard to a sufficient extent. As a result, part of the pins of the stacked connector will not be welded to the motherboard firmly and stably, thus forming some soldering defects like solder skip and solder short and after all affecting negatively the defective rate and quality and stability of digital signal transmission of the electrical connector.

SUMMARY OF THE INVENTION

In view of the forgoing problems, the present invention provides an electrical connector that can ensure a low defective rate and a high quality of the digital signal transmission of the electrical connector.

The present invention discloses an electrical connector that is adapted to a circuit board having a first connection port. The electrical connector comprises a base, a second connection port disposed on the base, a housing and a conductive element. The base is provided with a trough formed on one surface of the base, which forms a breach on an adjacent surface of the base, a first sidewall and a second sidewall are located in the trough and opposed each other, and the breach is formed between the first and the second sidewalls. The housing covers the base and the second connection port, and the trough of the base and the second connection port are exposed from the housing. The conductive element is disposed in the trough of the base, the conductive element comprises a body and a first elastic strip, the body penetrates the base and contacts with the housing, one end of the first elastic strip is connected to the body and located adjacent to the first sidewall of the base, and the other end of the first elastic strip extends toward the breach of the base and is capable of reciprocating between the first and the second sidewalls of the base arbitrarily.

Wherein, when the electrical connector is combined with the circuit board, the first connection port of the circuit board is accommodated in the trough of the base and exposed from the breach, the housing is contacted with the circuit board, the second connection port is located above the first connection port, and the first elastic strip of the conductive element is pressed against the first connection port.

The present invention further discloses an electrical connector comprising a base, a first connection port, a second connection port, a housing and a conductive element. The base is provided with a trough formed on one surface of the base, which forms a breach on an adjacent surface of the base, and a first sidewall and a second sidewall are located in the trough and opposed each other, and the breach is formed between the first and the second sidewalls. The first connection port is located in the trough of the base and exposed from the breach. The second connection port is disposed on the base and stacked on the first connection port. The housing covers the base and the second connection port, wherein the trough of the base and the second connection port are exposed from the housing. The conductive element is located in the trough of the base and comprises a body and a first elastic strip. The body penetrates the base and contacts with the housing. One end of the first elastic strip is connected to the body and located adjacent to the first sidewall of the base; and the other end of the first elastic strip extends toward the breach of the base and is capable of reciprocating between the first and the second sidewalls of the base arbitrarily, wherein the first elastic strip is normally pressed against the first connection port.

In addition, the present invention discloses a bottom of an electrical connector, too. The bottom of the electrical connector comprises a base provided with a trough, and a conductive element, The trough is formed on one surface of the base and forms a breach on an adjacent surface of the base, and a first sidewall and a second sidewall are located in the trough respectively and opposed to each other, and the breach is formed between the first and the second sidewalls. The conductive element is disposed in the trough of the base, and comprises a body and a first elastic strip, wherein the body penetrates the base and exposed from the base, one end of the first elastic strip is connected to the body in the trough and located adjacent to the first sidewall of the base, and the other end of the first elastic strip extends toward to the breach of the base and is capable of reciprocating between the first and the second sidewalls of the base arbitrarily.

The effect of the present invention is achieved in the following way. The electrical connector is stably combined with the connection port on the circuit board by the elastic strip of the conductive element that provides an elastic restoring force between the first and the second sidewalls of the base. In addition, when the circuit board combined with the electrical connector and the connection port is given transportation, the reacting force between the first connection port and the electrical connector vertical to the circuit board is reduced or eliminated because the elastic strip is pressed against the connection port along a direction parallel to the circuit board under the elastic restoring force. Therefore, some soldering defects that will probably occur afterward, such as solder skip and solder short, may be prevented, and the defective rate is reduced and quality and stability of digital signal transmission of the electrical connector are improved effectively.

The characteristics, realization and functions of the invention are disclosed in the following description with reference to the preferred exemplified embodiments and the accompanying drawings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

Figure 1:
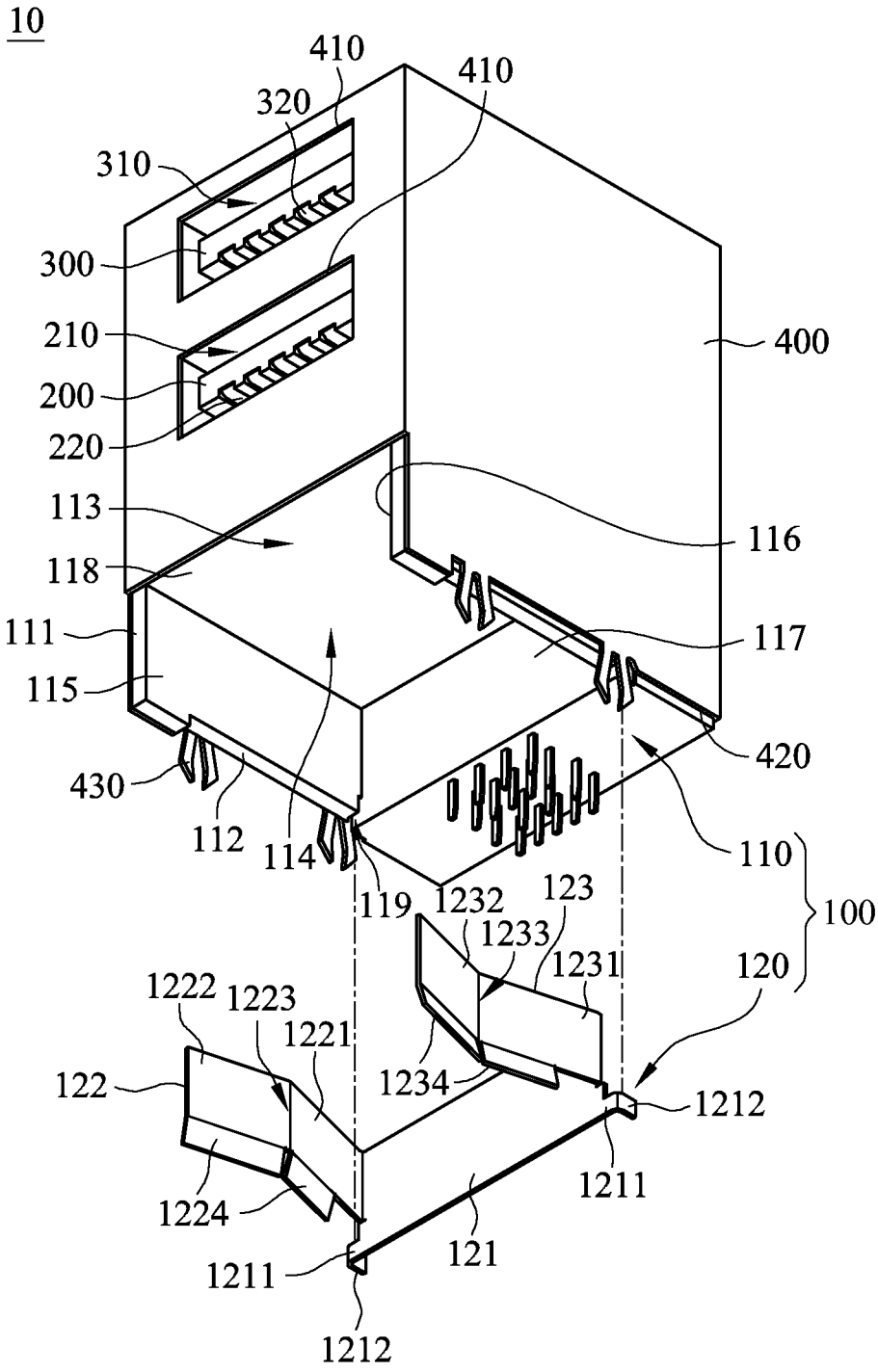
FIG. 1 is an exploded view of a connector according to a first embodiment of the present invention.

As shown in FIGS. 1-4, the electrical connector 10 of the first embodiment is adapted to a circuit board 30 having a first connection port 20. The first connection port 20 may be but not limited to a HDMI port, a display port, or a network interface card (NIC) port or the like. The electrical connector 10 includes a bottom 100, a second connection port 200, a third connection port 300 and a housing 400. The bottom 100 includes a base 110 having a first surface 111 and a second surface 112 that are adjacent to each other with an angle therebetween and a conductive element 120. A trough 114 is formed on the second surface 112 of the base 110 and forms a breach 113 on the first surface 111 of the base 110. The trough 114 has a first sidewall 115 and a second sidewall 116 that are opposed each other and located on two opposite sides of the breach 113. A third sidewall 117 and a fourth sidewall 118 are formed and connected between the first and the second sidewalls 115 and 116.

In this embodiment, the first and the second sidewalls 115 and 116 are perpendicular to the first and the second surfaces 111 and 112, the third sidewall 117 is opposite to the breach 113, parallel to the first surface 111, and perpendicular to the second surface 112, and the fourth sidewall 118 is connected to the first, second, and third sidewalls 115, 116, and 117, parallel to the second surface 112 and perpendicular to the first surface 111. However, it is to be noted that the above configuration is only illustrative and the invention is not limited thereto.

The conductive element 120 is located in the trough 114 and made of a conductive, flexible, and deformable material such as metal like copper or aluminum. The conductive element 120 includes a body 121, a first elastic strip 122 and a second elastic strip 123. The body 121 at both sides thereof has an engagement portion 1211 together with a bending portion 1212 connected to the engagement portion 1211 and is located in the trough 114 next to the third sidewall 117. It is to be noted that the engagement portion 1211 is formed by extending from the body 121, while the bending portion 1212 is formed by bending and extending from the engagement portion 1211. Besides, a trench 119 is respectively formed on the second surface 112 near the border with the third sidewall 117 at two opposite sides of the trough 114. The conductive element 120 is combined detachably with the connector 10 occupying the trough 114 by inserting both engagement portions 1211 of the body 121 into the trench 119 with the bending portion 1212 outside of the base 110 and approximate to the outer surface of the base 110.

The first and the second elastic strips 122 and 123 may be disposed for example respectively at two opposite sides of the body 121, and the engagement portions 1211 are also located correspondingly thereto. However, it is to be understood that the first and the second elastic strips 122 and 123 may be connected to the body 121 in other positions. The first elastic strip 122 has a free part 1222 and a binding part 1221 connected between the body 121 and the free part 1222. The binding part 1221 and the free part 1222 are connected with an angle therebetween such that an inflection piece 1223 is formed at the interface of both parts 1221 and 1222. In other words, in a three-dimensional view, the first elastic strip 122 is formed to be V-shaped with the apex (the inflection piece 1223) thereof projecting towards the second elastic strip 123, as illustrated in FIGS. 1-4.

Particularly, since the first elastic strip 122 is made of a flexible material and connected to the body 121 only via the binding part 1221, when the electrical connector 10 and the conductive element 120 are combined together, it is allowed to move along the first sidewall 115 in the direction out of the housing 400 towards the breach 113 of the base 110 once the inflection piece 1223 is subject to force. That is, the first elastic strip 122 is allowed to reciprocate in a direction from the first/second to the second/first sidewall of the base 110 arbitrarily. In addition, the first elastic strip 122 further includes a guiding piece 1224 which is located on one side thereof that when the conductive element 120 is combined with the electrical connector 10, the guiding piece 1224 is farther away from the fourth sidewall 118. The guiding piece 1224 serves to facilitate the smooth movement (reciprocation) of the first elastic strip 122. It is noted that the guiding piece 1224 may be extended from the binding part 1221 and/or the free part 1222, and this is for illustration only rather than limitation.

Similarly, the second elastic strip 123 also has a binding part 1231, a free part 1232, an inflection piece 1233, and a guiding piece 1234. Since the second elastic strip 123 is made of a flexible material and connected to the body 121 only via the binding part 1231, when the electrical connector 10 and the conductive element 120 are combined together, it is allowed to move along the second sidewall 116 in the direction out of the housing 400 towards the breach 113 of the base 110 once the inflection piece 1233 is subject to force. The guiding piece 1234 of the second elastic strip 123 is located at one side thereof that when the conductive element 120 is combined with the electrical connector 10, the guiding piece 1234 is farther away from the fourth sidewall 118. It is noted that the guiding piece 1234 may be extended from the binding part 1231 and/or the free part 1232.

The binding part 1231 is connected between the body 121 and the free part 1232 and forms an angle with the free part 1232 so that the inflection piece 1233 is formed at the interface of both parts 1231 and 1232. In other words, in a three-dimensional view, the second elastic strip 123 is formed to be V-shaped with the apex (the inflection piece 1233) thereof projecting towards the first elastic strip 122, as illustrated in FIGS. 1-4.

Besides, as described above, because the first and the second elastic strip 122 and 123 are both three-dimensionally V-shaped, once the inflection pieces 1223 and 1233 are subject to force, the elastic strips 122 and 123 are deformed first and then allowed to move respectively along the first sidewall 115 and the second sidewall 116 in the direction out of the housing 400 towards the breach 113 of the base 110 under the condition that the electrical connector 10 and the conductive element 120 are combined together. Therefore, the first and the second elastic strips 122 and 123 are designed to have length and width which will be equal to or less than length and width of the trough 114 of the base 110 when their respective inflection pieces 1223 and 1233 are subject to force, so that they won't overstep the base 110.

Figure 2:
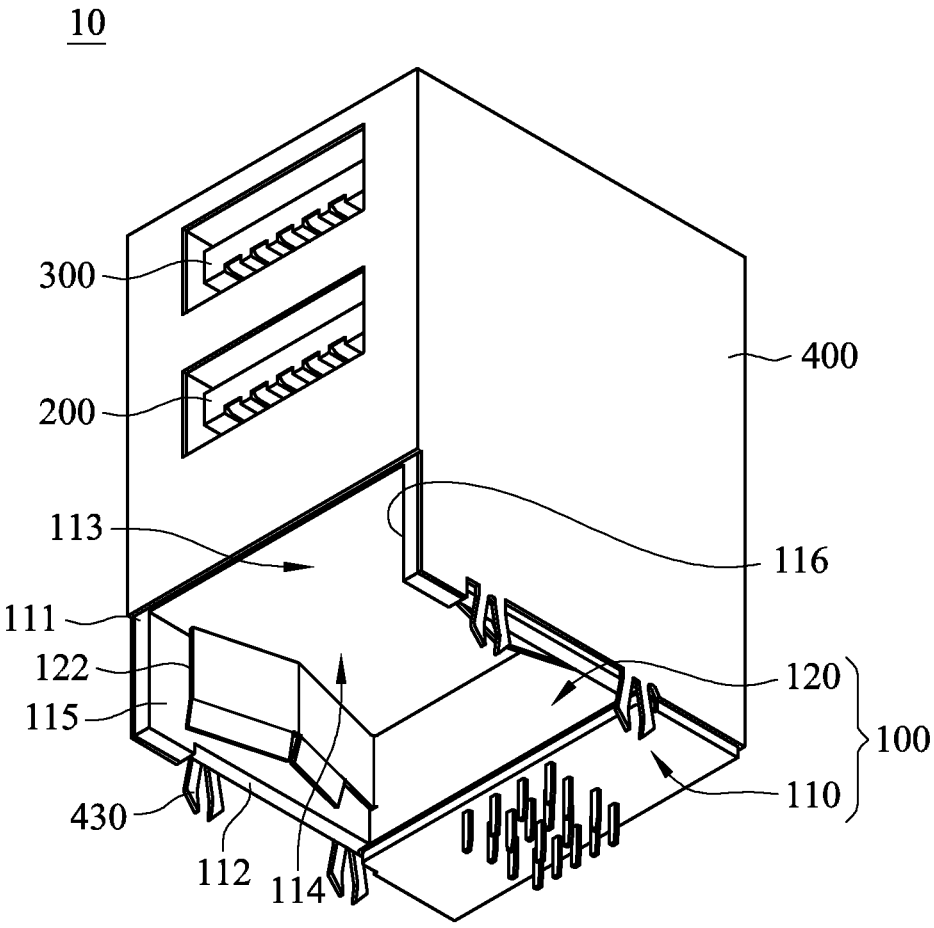
FIG. 2 is a schematic assembly view of the connector according to the first embodiment of the present invention.
Figure 3:
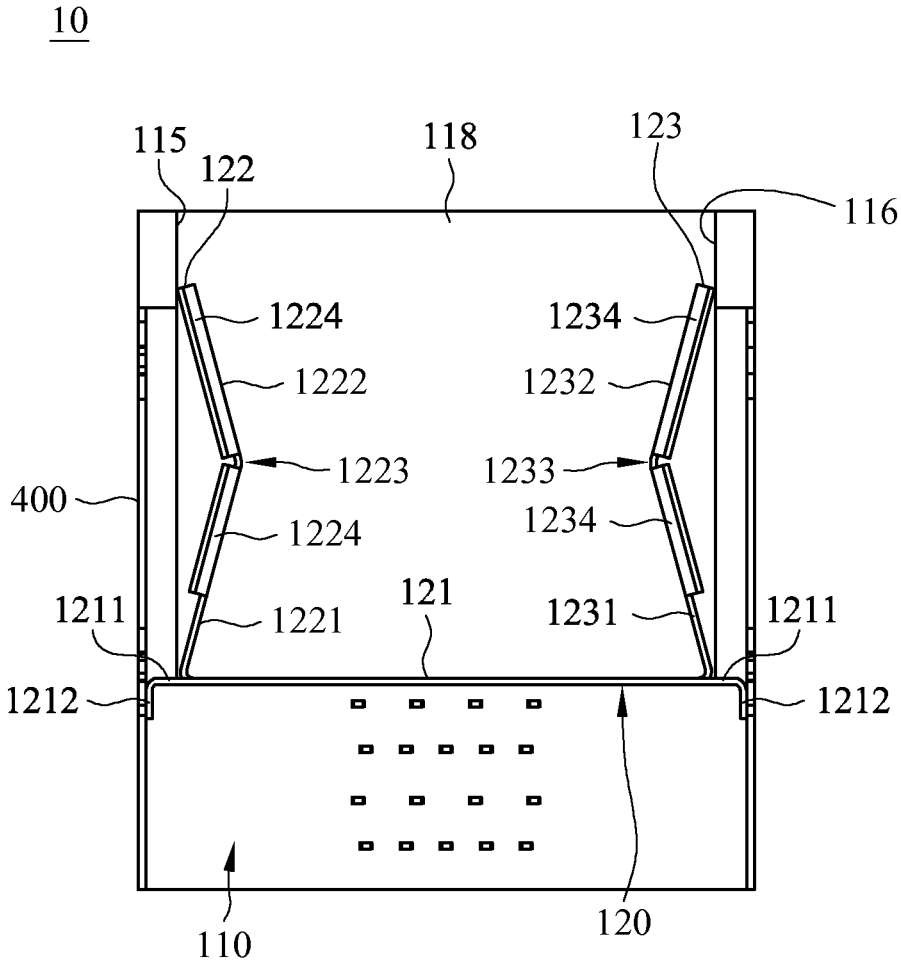
FIG. 3 is a base view of the connector according to the first embodiment of the present invention.
Figure 4:
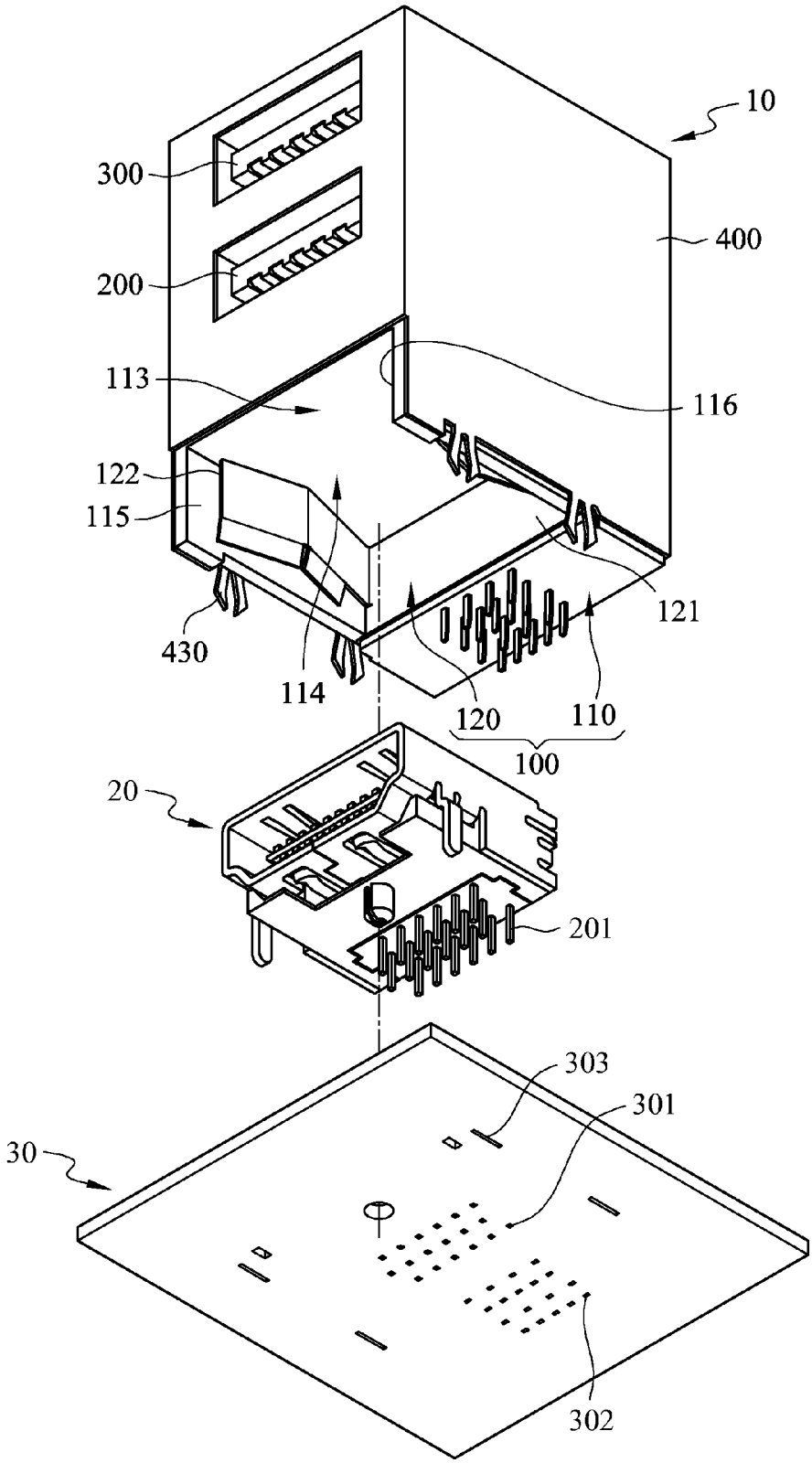
FIGS. 4-6 are exemplary state diagrams for using the connector of the first embodiment of the present invention.

As shown in FIGS. 1-3, the second and the third connection ports 200 and 300 of the electrical connector 10 are provided in stack on the base 110 of the bottom 100 above the trough 114. The second and the third connection ports 200 and 300 may be for example USB ports, NIC ports, display ports or HDMI ports or the like. Also, the second and the third connection ports 200 and 300 have respectively sockets 210 and 310 exposed from the first surface 111 of the base 110 and a plurality of conductive terminals 220 and 320 each having one end located within the socket and the other end exposed from the base 110.

The housing 400 of the electrical connector 10 covers the base 110 of the bottom 100 and is made of conductive material such as metal like copper or aluminum. The bending part 1212 of the body 121 is clipped between the housing 400 and the base 110, by way of which the first and the second elastic strips 122 and 123 of the conductive element 120 is connected to the housing 400. Besides, a plurality of first holes 410 corresponding to the second and the third connection ports 200 and 300 and a second hole 420 corresponding to the second surface 112 and the breach 113 of the base 110 are defined on the housing 400. The respective sockets 210 and 310 of the second and the third connection ports 200 and 300 are exposed from the electrical connector 10 at one side via the first holes 410 of the housing 400, while the second surface 112, the trough 114 of the base 110 are exposed from the electrical connector 10 via the second hole 420 of the housing 400.

Also, a plurality of fasteners 430 are provided to the housing 400 at the side of the second surface 112 and along the first and the second sidewalls 115 and 116. The fastener 430 may be, for example, a hook formed integrally extending from the housing 400, while the invention is not limited thereto.

In the first embodiment of the invention, by referring to FIGS. 1 and 4-6, the first connection port 20 is electrically provided to the circuit board 30 first, then the electrical connector 10 is plugged in the circuit board 30 together with the first connection port 20. However, it will be understood that the above assembling process is simply illustrative, and the electrical connector 10, the first connection port 20, and the circuit board 30 may be joined together in other ways. For example, as the first step, the first connection port 20 is combined with the electrical connector 10, next, the combination is connected to the circuit board 30.

The circuit board 30 is provided with a plurality of the first and the second electrical holes 301 and 302 and a plurality of positioning holes 303. The first connection port 20 can be connected to the circuit board 30 by inserting the plurality of conductive terminals 201 into the plurality of the first electrical holes 301 on the circuit board 30. When the electrical connector 10 and the circuit board 30 are connected, the first connection port 20 is received in the trough 114 of the base 110 of the electrical connector 10, the conductive terminals 220 of the second connection port 200 and the conductive terminals 320 of the third connection port 300 are inserted respectively in the second electrical holes 302 of the circuit board 30, and the fasteners 430 are inserted into the positioning holes 303 correspondingly. In particular, since the fasteners 430 are pressed against the inner wall of the positioning holes 303, the electrical connector 10 is secured firmly to the circuit board 30.

Figure 5:
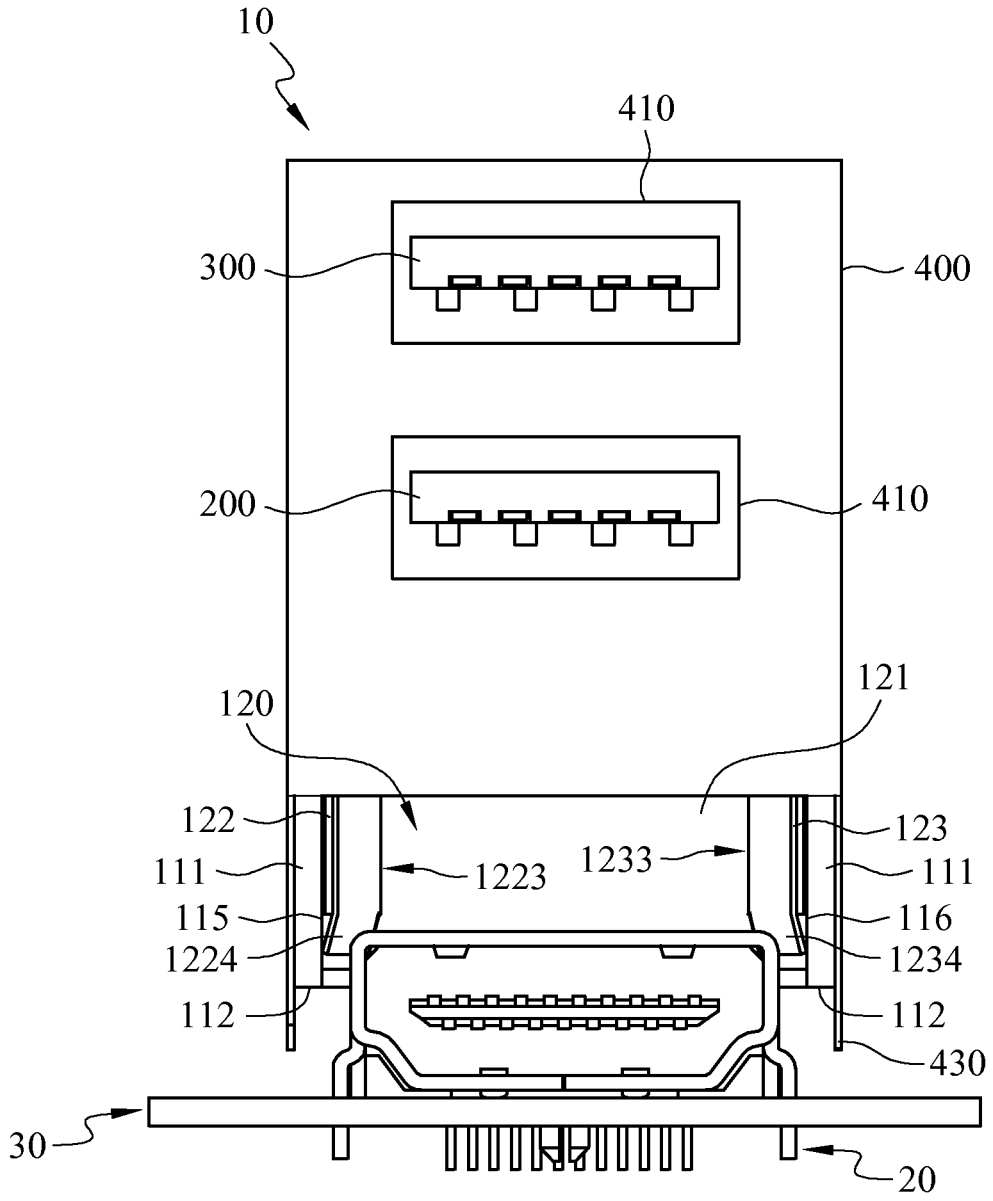
Figure 6:
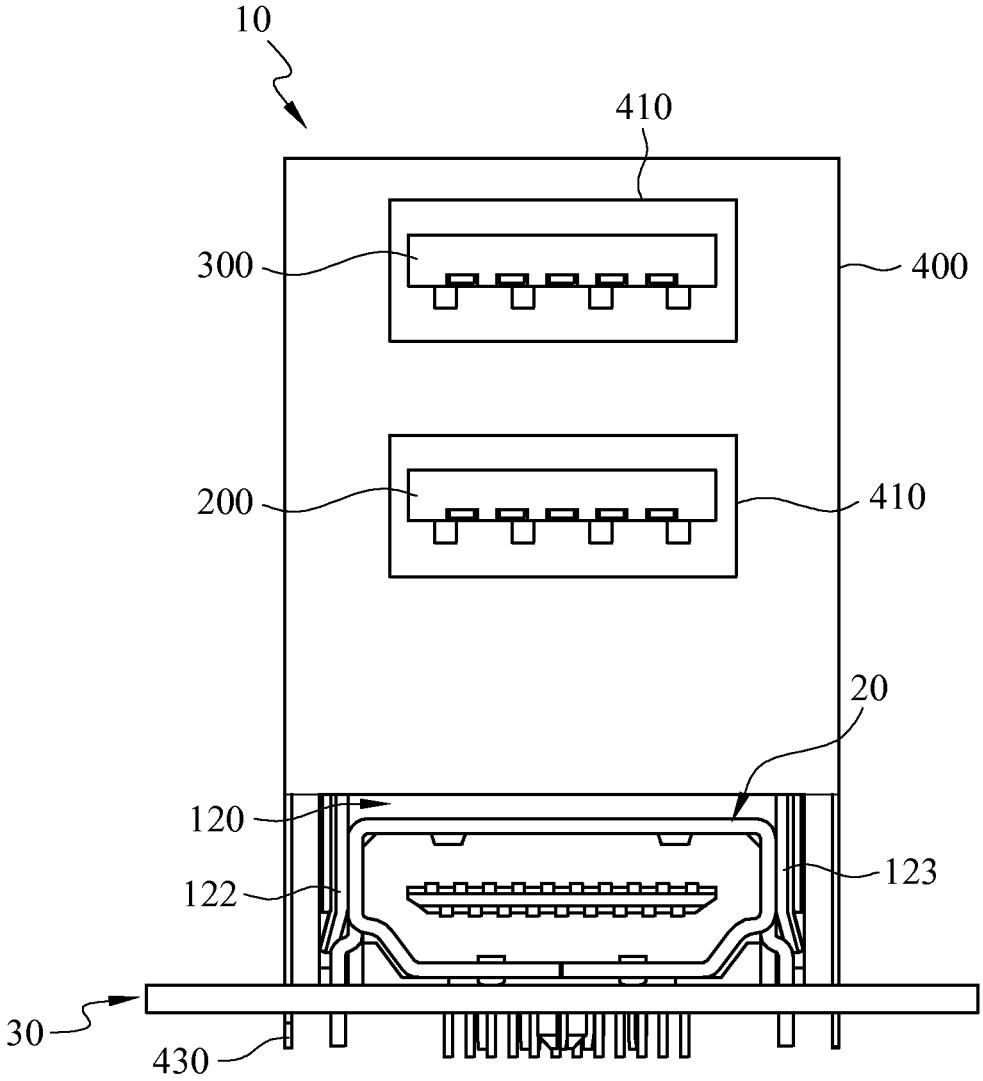

In more detail, the first connection port 20 is received in the trough 114 and exposed from the breach 113 of the base 110 as follows. First, the guiding piece 1224 of the elastic strip 122 and the guiding piece 1234 of the second elastic strip 123 both reach against a surface of the first connection port 20, as shown in FIG. 5. Next, the first connection port 20 is clasped tightly between the first and the second elastic strips 122 and 123 by compressing the guiding pieces 1224 and 1234 thereof to make the first and the second elastic strips 122 and 123 deformed and then move respectively along the first sidewall 115 and the second sidewall 116 in the direction out of the housing 400 towards the breach 113 of the base 110. Thus, the base 110 will slip towards the circuit board 30 under the guide of the guiding pieces 1224 and 1234 and engaged properly with the first connection port 20, as shown in FIG. 6.

In addition, when the first connection port 20 touches and pushes the inflection piece 1223/1233 of the first/second elastic strips 122/123 such that the first/second elastic strips 122/123 deform, an elastic restoring force for the first/second elastic strips 122/123 is generated toward the second/first sidewall 116/115. Such elastic restoring force serves as "clamping force" parallel to the circuit board 30 for fixing firmly the first connection port 20 to the electrical connector 10. Also, since the first connection port 20 is electrically connected with the housing 400 of the electrical connector 10 via the conductive element 120, it can be shielded from the electromagnetic interference.

Further, the design of the first and the second elastic strips 122 and 123 is efficacious in preventing the separation or loose connection of the electrical connector 10 from the first connection port 20 or the circuit board 30 by reducing or eliminating the reacting force between the first connection port 20 and the fourth sidewall 118 of the base 110, when the electrical connector 10 and the first connection port 20 are plugged into the circuit board 30 before the welding process. Based on the above mentioned structure, the soldering defects like solder skip and solder short frequently occurred during the welding process are avoided between the electrical connector 10 and the circuit board 30, so the defective rate is decreased and quality and stability of the digital signal transmission of the electrical connector 10 is improved.

Figure 7:
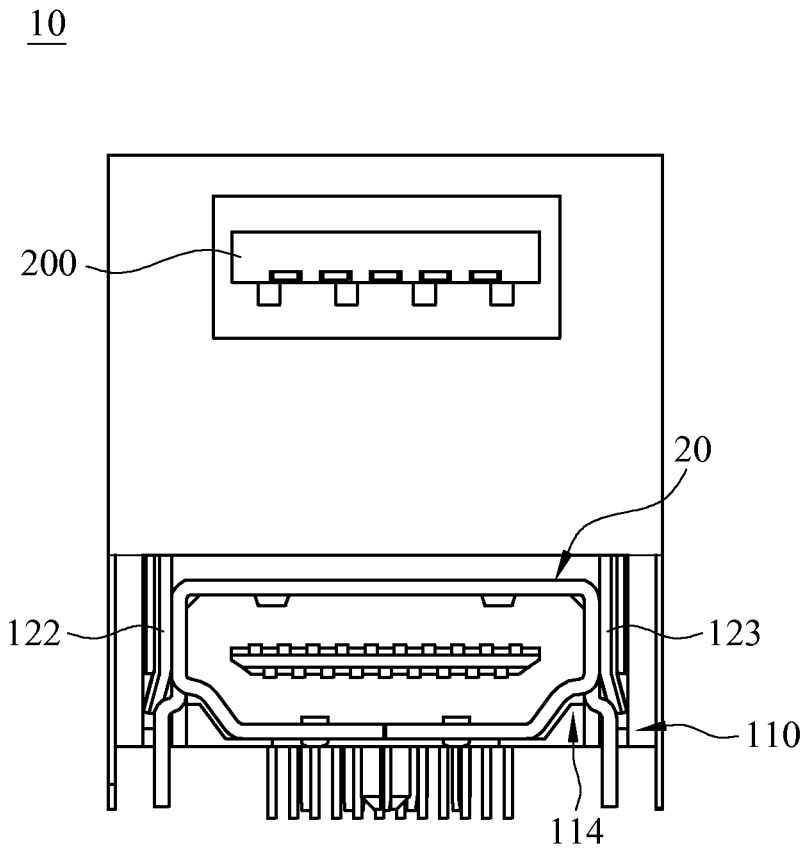
FIG. 7 is a schematic assembly view of a connector according to a second embodiment of the present invention.

FIG. 7 is a schematic assembly view of the electrical connector of the second embodiment. The electrical connector 10 of the second embodiment is similar to that of the first embodiment in structure except in the former, the first connection port 20 is regarded as a constituent of the electrical connector 10 and has been disposed in the trough 114 of the base 110 beforehand, and the third connection port 300 is removed from the electrical connector 10. Similar to the first embodiment, the first connection port 20 is firmly secured on the base 110 of the electrical connector 10 by (the elastic restoring force of) the first and the second elastic strips 122 and 123. In this way, when the electrical connector 10 is connected with the circuit board 30, loose connection or separation of the first connection port 20 from the base 110 of the electrical connector 10 can be prevented effectively.

In addition, the first connection port 20 is detachably disposed into the trough 114 of the base 110 through the clamping effect provided by the first and the second elastic strips 122 and 123, so the type of the first connection port 20 may be selected as desired. That is, the assembly and application of the electrical connector 10 will be more flexible.

Figure 8:
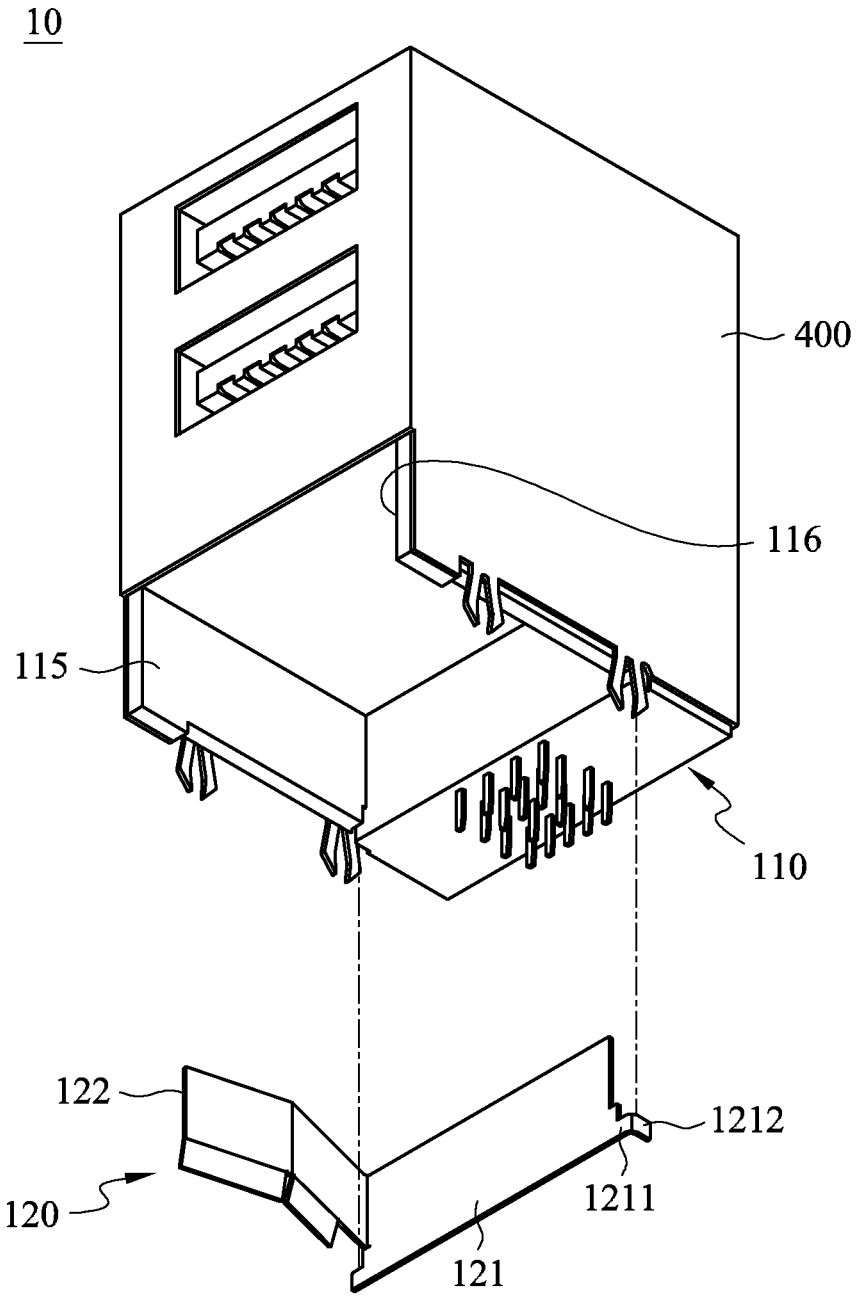
FIG. 8 is an exploded view of a connector according to a third embodiment of the present invention.

FIG. 8 is an exploded view of the electrical connector 10 of the third embodiment, which is similar to that of the first embodiment in structure except in the former, the conductive element 120 does not include a second elastic strip 123, and the body 121 has an engagement portion 1211 together with a bending portion 1212 connected thereto only at one side. When the electrical connector 10 is connected to a circuit board having a first connection port (not shown), similar to the first embodiment of the invention, the first connection port can be clamped and held spatially between the first elastic strip 122 and the second sidewall 116 by means of the elastic restoring force from the first elastic strip 122 of the conductive element 120. Also, since the first connection port 20 is electrically connected with the housing 400 of the electrical connector 10 via the conductive element 120, it can be shielded from the electromagnetic interference.

However, it is to be noted that a skilled person in the art may modify the structure of the elastic strip(s) of the conductive element and the number of the connection ports of the electrical connector as required.

In the present invention, because the elastic strip of the conductive element provides an elastic restoring force that facilitates reducing or eliminating the reacting force between the first connection port and the electrical connector which is vertical to the circuit board, the separation or loose connection of the electrical connector from the connection port is prevented. This ensures successful welding of conductive terminals of the electrical connector to the circuit board, and thus a reduced defective rate and an improved quality and stability of the digital signal transmission of the electrical connector.

From the above description of the invention, it is manifest that various techniques can be used for implementing the concepts of the invention without departing from the scope thereof. Moreover, while the invention has been described with specific reference to certain embodiments, a person of ordinary skills in the art would recognize that changes can be made in form and detail without departing from the spirit and the scope of the invention. The described embodiments are to be considered in all respects as illustrative and not restrictive. It is intended that the scope of the invention is defined by the appended claims.

What is claimed is:

1. An electrical connector adapted to a circuit board having a first connection port, the electrical connector comprising:

a base provided with a trough formed on one surface of the base, which forms a breach on an adjacent surface of the base, and a first sidewall and a second sidewall located in the trough and opposed to each other, the breach being formed between the first and the second sidewalls;

a second connection port disposed on the base;

a housing covering the base and the second connection port, wherein the trough of the base and the second connection port are exposed from the housing; and a conductive element comprising a body and a first elastic strip and disposed in the trough of the base, wherein the body penetrates the base and contacts with the housing, one end of the first elastic strip is connected to the body and located adjacent to the first sidewall of the base, and the other end of the first elastic strip extends toward the breach of the base and is capable of reciprocating between the first and the second sidewalls of the base arbitrarily, wherein when the electrical connector is combined with the circuit board, the first connection port of the circuit board is accommodated in the trough of the base and exposed from the breach, the housing is contacted with the circuit board, the second connection port is located above the first connection port, and the first elastic strip of the conductive element is pressed against the first connection port.

2. The electrical connector according to claim 1, wherein the first elastic strip of the conductive element comprises an inflection piece facing the second sidewall of the base, by way of which the conductive element is pressed against the first connection port.

3. The electrical connector according to claim 2, wherein the first elastic strip further comprises a free part and a binding part connected between the body and the free part with an angle therebetween, and the inflection piece is formed at an interface of the free part and the binding part.

4. The electrical connector according to claim 1, wherein the first elastic strip of the conductive element further comprises a guiding piece located at one side of the first elastic strip that is away from the second connection port.

5. The electrical connector according to claim 1, wherein the conductive element further comprises a second elastic strip spaced apart from the first elastic strip by the body, one end of the second elastic strip is connected to the body and located adjacent to the second sidewall of the base, the other end of the second elastic strip extends toward the breach of the base and is capable of reciprocating between the first and the second sidewalls of the base arbitrarily.

6. The electrical connector according to claim 1, wherein the base further has a trench defined on one side of the base adjacent to the trough, and the body of the conductive element comprises an engagement portion inserted into the trench and a bending portion clipped between the housing and the base.

7. The electrical connector according to claim 1, wherein a first hole of the housing corresponding to the second connection port and a second hole of the housing corresponding to the trough of the base.

8. An electrical connector, comprising:

a base provided with a trough formed on one surface of the base, which forms a breach on an adjacent surface of the base, and a first sidewall and a second sidewall located in the trough and opposed each other, the breach being formed between the first and the second sidewalls;

a first connection port located in the trough of the base and exposed from the breach;

a second connection port disposed on the base and stacked on the first connection port;

a housing covering the base and the second connection port, wherein the trough of the base and the second connection port are exposed from the housing; and a conductive element comprising a body and a first elastic strip and disposed in the trough of the base, wherein the body penetrates the base and contacts with the housing, one end of the first elastic strip is connected to the body and located adjacent to the first sidewall of the base, and the other end of the first elastic strip extends toward the breach of the base and is capable of reciprocating between the first and the second sidewalls of the base arbitrarily, wherein the first elastic strip is normally pressed against the first connection port.

9. The electrical connector according to claim 8, wherein the first elastic strip of the conductive element comprises an inflection piece facing the second sidewall of the base, by way of which the conductive element is pressed against the first connection port.

10. The electrical connector according to claim 9, wherein the first elastic strip further comprises a free part and a binding part connected between the body and the free part with an angle therebetween, and the inflection piece is formed at an interface of the free part and the binding part.

11. The electrical connector according to claim 8, wherein the first elastic strip of the conductive element further comprises a guiding piece located at one side of the first elastic strip that is away from the second connection port.

12. The electrical connector according to claim 8, wherein the conductive element further comprises a second elastic strip spaced apart from the first elastic strip by the body, one end of the second elastic strip is connected to the body and located adjacent to the second sidewall of the base, the other end of the second elastic strip extends toward the breach of the base and is capable of reciprocating between the first and the second sidewalls of the base arbitrarily.

13. The electrical connector according to claim 8, wherein the base further has a trench defined on one side of the base adjacent to the trough, and the body of the conductive element comprises an engagement portion inserted into the trench and a bending portion clipped between the housing and the base.

14. The electrical connector according to claim 8, wherein a first hole of the housing corresponding to the second connection port and a second hole of the housing corresponding to the trough of the base.

15. A bottom of an electrical connector, comprising:

a base provided with a trough formed on one surface of the base, which forms a breach on an adjacent surface of the base, and a first sidewall and a second sidewall located in the trough and opposed to each other, the breach being formed between the first and the second sidewalls; and a conductive element comprising a body and a first elastic strip and disposed in the trough of the base, wherein the body penetrates the base and exposed from the base, one end of the first elastic strip is connected to the body in the through and located adjacent to the first sidewall of the base, and the other end of the first elastic strip extends toward the breach of the base and is capable of reciprocating between the first and the second sidewalls of the base arbitrarily.

16. The bottom of the electrical connector according to claim 15, wherein the first elastic strip of the conductive element comprises an inflection piece facing the second sidewall of the base.

17. The bottom of the electrical connector according to claim 16, wherein the first elastic strip further comprises a free part and a binding part connected between the body and the free part with an angle therebetween, and the inflection piece is formed at an interface of the free part and the binding part.

18. The bottom of the electrical connector according to claim 15, wherein the first elastic strip of the conductive element further comprises a guiding piece located at one side of the first elastic strip that is exposed from the trough of the base.

19. The bottom of the electrical connector according to claim 15, wherein the conductive element further comprises a second elastic strip spaced apart from the first elastic strip by the body, one end of the second elastic strip is connected to the body and located adjacent to the second sidewall of the base, the other end of the second elastic strip extends toward the breach of the base and is capable of reciprocating between the first and the second sidewalls of the base arbitrarily.

20. The bottom of the electrical connector according to claim 15, wherein the base further has a trench defined on one side of the base adjacent to the trough, and the body of the conductive element comprises an engagement portion inserted into the trench and a bending portion exposed from the base.

* * * * *